US010814505B2

(12) United States Patent
Schekalla

(10) Patent No.: US 10,814,505 B2
(45) **Date of Patent: *Oct. 27, 2020**

(54) KNIFE WITH AUTOMATIC BLADE RETRACTION

(71) Applicant: MARTOR KG, Solingen (DE)

(72) Inventor: Peter Schekalla, Wuppertal (DE)

(73) Assignee: MARTOR KG, Solingen (DE)

( * ) Notice: Subject to any disclaimer, the term of this patent is extended or adjusted under 35 U.S.C. 154(b) by 81 days.

This patent is subject to a terminal disclaimer.

(21) Appl. No.: 16/140,844

(22) Filed: Sep. 25, 2018

(65) Prior Publication Data

US 2019/0022879 A1 Jan. 24, 2019

Related U.S. Application Data

(63) Continuation of application No. 14/739,961, filed on Jun. 15, 2015, now Pat. No. 10,112,312.

(30) Foreign Application Priority Data

May 6, 2014 (DE) ..... 10 2014 208 473

(51) Int. Cl.
*B26B 5/00* (2006.01)

(52) U.S. Cl.
CPC ..... *B26B 5/003* (2013.01)

(58) Field of Classification Search
CPC ..... B26B 5/003
(Continued)

(56) References Cited

U.S. PATENT DOCUMENTS 6,148,520 A * 11/2000 Berns ..... B26B 5/003 30/162
6,553,673 B2 * 4/2003 Peyrot ..... B26B 5/003 30/162

(Continued)

FOREIGN PATENT DOCUMENTS

AU 2013202032 A1 1/2014
CN 102223988 A 10/2011

(Continued)

OTHER PUBLICATIONS

Deutches Patent, Official Action in German Application No. 10 2014 208 473.3 dated Feb. 13, 2015.

(Continued)

*Primary Examiner* — Ghassem Alie
*Assistant Examiner* — Bharat C Patel
(74) *Attorney, Agent, or Firm* — Thompson Hine LLP

(57) ABSTRACT

A knife with automatic blade retraction including a housing, a moveable actuating device, a rotatable blade unit, and a retraction element which always applies a retraction force to the blade unit in the direction of the retracted position. The rotatable blade unit can be brought into engagement with the actuating device and is moveable by means of the actuating device from a position retracted in the housing into a position extended from the housing. The blade unit is also rotatable by the action of a cutting force in an extended position from an engagement position in which the blade unit is in engagement with the actuating device into a release position in which the blade unit is not in engagement with the actuating device.

7 Claims, 7 Drawing Sheets

(58) Field of Classification Search
USPC ... 30/155, 158–161, 307, 319, 164, 95, 365, 30/114, 2, 151, 162, 286, 289, 292, 293
See application file for complete search history.

(56) References Cited

U.S. PATENT DOCUMENTS

| | | | | |
|---|---|---|---|---|
| 7,316,070 | B2 * | 1/2008 | Green | B26B 5/001 30/162 |
| 7,765,701 | B2 * | 8/2010 | Okada | B26B 5/003 30/162 |
| 8,056,241 | B2 | 11/2011 | Davis et al. | |
| 8,220,160 | B2 * | 7/2012 | Davis | A45F 5/02 30/162 |
| 8,561,305 | B2 * | 10/2013 | Davis | B26B 5/003 30/162 |
| 8,707,566 | B2 * | 4/2014 | Rohrbach | B26B 5/001 30/162 |
| 8,769,826 | B2 * | 7/2014 | Wu | B26B 5/003 30/125 |
| 8,776,380 | B1 * | 7/2014 | Quimby | B26B 5/003 30/155 |
| 9,358,692 | B2 * | 6/2016 | Schekalla | B26B 5/003 |
| 10,112,312 | B2 * | 10/2018 | Schekalla | B26B 5/003 |
| 10,124,495 | B2 * | 11/2018 | Gallegos | B26B 5/001 |
| 10,245,736 | B2 * | 4/2019 | Huang | B26B 5/003 |
| 2005/0193568 | A1 * | 9/2005 | Peyrot | B26B 5/001 30/162 |
| 2009/0106983 | A1 | 4/2009 | Berns | |
| 2009/0277016 | A1 * | 11/2009 | Wu | B26B 5/003 30/162 |
| 2011/0035947 | A1 | 2/2011 | Rohrbach | |
| 2013/0091712 | A1 | 4/2013 | Schekalla | |
| 2015/0013171 | A1 * | 1/2015 | Wu | B26B 5/001 30/162 |
| 2016/0311123 | A1 * | 10/2016 | Schoon | B26B 27/007 |

FOREIGN PATENT DOCUMENTS

| | | | | |
|---|---|---|---|---|
| CN | 102729262 | A | 10/2012 | |
| DE | 102007052060 | A1 | 5/2009 | |
| DE | 102011007234 | A1 | 9/2012 | |
| DE | 202013101416 | A1 | 8/2013 | |
| EP | 1985417 | A1 * | 10/2008 | B26B 5/003 |
| EP | 1864766 | B1 | 10/2010 | |
| EP | 2388113 | A1 * | 11/2011 | B26B 5/001 |
| FR | 3001908 | A1 * | 8/2014 | B26B 5/003 |
| WO | 2014125004 | A1 | 8/2014 | |

OTHER PUBLICATIONS

European Patent Office, Search Report and Written Opinion issued in corresponding Application No. 15174319.2 dated Oct. 14, 2015.
China National Intellectual Property Administration, Office Action and Search Report issued in Chinese Patent Application 201510350454.6 dated Nov. 28, 2018.

* cited by examiner

KNIFE WITH AUTOMATIC BLADE RETRACTION

TECHNICAL FIELD

The present invention concerns a knife with automatic blade retraction comprising a housing, a moveable actuating device, a rotatable blade unit, and a retraction element which always applies a retraction force to the blade unit in the direction of the retracted position. The rotatable blade unit can be brought into engagement with the actuating device and is moveable by means of the actuating device from a position retracted in the housing into a position extended from the housing. The blade unit is rotatable by the action of the cutting force in an extended position from an engagement position in which the blade unit is in engagement with the actuating device into a release position in which the blade unit is not in engagement with the actuating device.

BACKGROUND

Knives with automatic blade retraction permit automatic displacement of the blade from the extended position in which the blade projects at least portion-wise out of the housing of the knife into the retracted position in which the blade is usually disposed completely in the housing of the knife, irrespective of the actuating state of the actuating device.

The movement of the blade can thus be decoupled from the movement of the actuating device, by means of which the blade can usually be pushed out of the housing with the aid of the thumb or the index finger. Decoupling of the movements of blade and actuating device is implemented by the action of a cutting force on the blade. The action of the cutting force leads to a decoupling movement of the blade which can be for example in the form of a rotary movement. In the decoupling situation the actuating device releases the blade so that the blade and the actuating device can move independently of each other.

After the action of the cutting force on the blade is removed after the termination of the cutting operation the blade is moved directly and independently of the state of the actuating device from the extended position into the retracted position by means of the retraction element.

Knives with automatic blade retraction are designed in particular for situations which involve unintentional movements during the cutting operation. Frequently the cutting capability of the blade or the resistance that the material to be cut can put up is incorrectly estimated by users of the knives of that kind so that the user of the knife, by virtue of an excessively high application of force, loses control over the movements involved as soon as the blade leaves the material being cut. By virtue of those uncontrolled movements of the knife a knife with the extended blade would represent a serious risk of injury to the user of the knife himself, and also for people in the proximity. That can also involve unintentional damage to articles around it.

Such injuries to people and damage to articles due to unintentional and uncontrolled movement of the knife are avoided by automatic blade retraction after the action of the cutting force on the blade ceases. By virtue of the enhanced safety aspect during use of such knives they are also referred to as safety knives.

The safety knives in the state of the art generally involve a complex mechanism which, in the event of excessive stressing, are exposed to a high level of risk of a malfunction. In particular the blade guidance and the decoupling mechanism of known safety knifes regularly suffer malfunctions if the knife housing is damaged or deformed by virtue of being overstressed.

A safety knife with automatic blade retraction is known for example from EP 1 864 766 B1. The proposed safety knife has a blade unit which is rotated in the housing under the effect of a cutting force and thus causes decoupling from the manually actuable actuating device. Because of the limited structural space within the knife housing longitudinal guidance for the blade unit is embodied by a pin which is arranged laterally on the blade unit and which is displaceable in a slot in the knife housing.

In the case of longitudinal guides of the above-described kind it can happen that, in the event of the knife being overstressed, for example due to an excessive transverse force acting on the knife housing, the guide elements can come out of engagement by virtue of the housing flexing. That would seriously adversely affect the functionality of the knife.

A safety knife is also known from DE 10 2011 007 234 B3 which has recourse to a separate coupling element in order to implement coupling or decoupling of the manually actuable actuating device and the cutting blade. In the proposed safety knife the mechanism is expanded by an additional delicate coupling mechanism.

SUMMARY

The object of the present invention is consequently that of providing an improved knife with automatic blade retraction. In particular an object of the present invention is to provide a knife which in comparison with the known knives has a reduced risk of a malfunction and/or increased robustness in relation to excessive stressing.

The object of the invention is attained thereby with a knife of the kind set forth in the opening part of this specification, with a moveable slide member on which the blade unit is rotatably mounted.

The invention makes use of the realization that an additional moveable slide member dispenses with the need for the blade unit to be guided by means of the housing. If the housing suffers from damage or yieldingly flexes then the knife according to the invention has a considerably reduced risk of a malfunction in comparison with the known solutions. In addition the knife according to the invention dispenses with a separate coupling element, whereby the knife mechanism is substantially simplified.

In a first preferred embodiment of the knife according to the invention the slide member is displaceable jointly with the blade unit between the retracted position and the extended position along a longitudinal axis. Preferably both the slide member and also the blade unit are arranged completely in the housing of the knife in the retracted position. Because the blade unit in the movement of the slide member between the retracted position and the extended position is also moved from the retracted position into the extended position it is possible for contact between the blade unit and the housing to be entirely avoided. The situation only involves contact of the slide member with the housing of the knife. Because contact between the blade unit and the housing is avoided the risk of a malfunction in the event of housing damage like for example fracture of the housing or deformation of the housing is further reduced.

In a second preferred embodiment of the knife according to the invention the slide member is so guided that a rotary movement of the slide member is substantially prevented.

Tilting of the slide member or of the blade unit which is mounted rotatably on the slide member is thus avoided.

In a further preferred embodiment of the knife according to the invention the slide member has an abutment which in the extended position of the blade unit cooperates in positively locking relationship with the housing or the actuating device in such a way that further extension of the blade unit is prevented. As the limitation on the movement of the blade unit is not effected by way of the blade unit itself but by way of the slide member on which the blade unit is rotatably mounted the function of limiting the movement of the blade unit, that is relevant in terms of safety aspects, is performed by a component which is not rotatable within the housing. It is possible to provide for reliably limiting the movement of the blade unit by means of the abutment by virtue of the non-rotatability of the slide member.

A further development of the knife according to the invention provides that the blade unit includes a blade and a blade carrier. In that case the blade is connected to the blade carrier in such a way that a rotary movement between blade and blade carrier is substantially prevented. In particular the blade has one, two or more apertures into which one, two or more projections on the blade carrier engage. The connection between blade and blade carrier can further be in the form of an adhesive connection, a stamped connection, a screw connection or a clamping connection. A blade unit which is in two or more parts in that fashion provides for functional decoupling. That is to be interpreted as meaning that the blade is adapted to perform the cutting function and the blade carrier is adapted to implement mechanical coupling in relation to further knife elements like for example the retraction element. Such functional decoupling makes it possible to use materials appropriate to their respective function so that the blade unit for example is formed from stainless knife steel in order to improve the cutting properties of the knife and the knife carrier is made from a plastic material to which it is possible to impart a geometry which is advantageous in regard to incorporation in the knife mechanism and which is possibly complicated, by means of injection molding processes.

In a further preferred embodiment of the knife according to the invention the blade unit has an entrainment member which in the engagement position of the blade unit can be brought into engagement in positively locking relationship with the actuating device. In particular the entrainment member is of such a configuration that in the engagement position of the blade unit a part of the actuating device engages behind it. In that way the blade unit can admittedly be moved from the retracted position into the extended position by means of the actuating device, but not from the extended position into the retracted position. The entrainment member is preferably in the form of a projection which in the engagement position of the blade unit has an engagement surface which is substantially orthogonal to the longitudinal axis. The entrainment member is preferably formed on the blade carrier of the blade unit.

In a further preferred embodiment of the knife according to the invention the retraction element applies a retraction force to the blade unit in the direction of the engagement position. Consequently the retraction element is adapted to move the blade unit in the release position in which the blade unit is not in engagement with the actuating device, from the extended position into the retracted position, and to move the blade unit in the retracted position back from the release position into the engagement position. In particular the retraction force on the blade unit in the direction of the retracted position is the longitudinal force component and the retraction force on the blade unit in the direction of the engagement position is a transverse force component of the retraction force applied to the blade unit by the retraction element.

In a particularly preferred embodiment of the knife according to the invention the housing or the actuating device with the blade unit forms a holding mechanism, by means of which a rotary movement of the blade unit is prevented in the direction of the engagement position after adoption of the release position in a movement of the blade unit from the extended position in the direction of the retracted position. That therefore involves the set rotary angle of the blade unit being maintained while the blade unit is moved from the extended position in the direction of the retracted position by the retraction element.

An advantageous development of the knife according to the invention provides that the holding mechanism enables the rotary movement of the blade unit in the direction of the engagement position again only when the retracted position of the blade unit is reached. Therefore the rotary angle of the blade unit is maintained throughout the entire retraction process from the extended position into the retracted position. In addition it is to be understood in accordance with the invention that the holding mechanism can also enable the rotary movement of the blade unit in the direction of the engagement position some millimeters before reaching the retracted position in order to ensure reliable operability even when fluctuating manufacturing tolerances are involved.

In a further preferred embodiment of the knife according to the invention the holding mechanism is in the form of a latching mechanism, wherein the housing or the actuating device and the blade unit have mutually cooperating latching elements. The rotary angle of the blade unit can be maintained in a particularly simple fashion by means of a latching mechanism. The necessary components of the latching mechanism can be produced for example by injection molding processes. Latching mechanisms do not require cost-intensive materials or component geometries so that such mechanisms are also advantageous from economic points of view.

In a further preferred embodiment of the knife according to the invention the latching element of the housing or of the actuating device has a hook portion and the latching element of the blade unit has a latching edge. The hook portion and the latching edge are of such a configuration and arrangement that, upon a rotary movement of the blade unit in the extended position from the engagement position into the release position, the hook portion engages over the latching edge in such a way that a rotary movement of the blade unit from the release position back into the engagement position is prevented.

In a further preferred embodiment of the knife according to the invention the latching element of the housing or the actuating device is elastically deflected in the rotary movement of the blade unit in the extended position from the engagement position into the release position. Such elastic latching mechanisms are also known as snap-action connections. Snap-action connections have a low level of risk of malfunction and are quick and inexpensive to produce.

A further development of the knife according to the invention also provides that the latching element of the housing or the actuating device has a leg which is in contact with the blade unit in the engagement position and/or the release position of the blade unit.

In a further preferred embodiment of the knife according to the invention the actuating device is moveable between a passive position and a cutting position and a second retraction element applies a retraction force to the actuating device in the direction of the passive position. The retraction force of the second retraction element provides that the actuating device is automatically moved back from the cutting position into the passive position as soon as the application of force to the actuating device, which is usually achieved by means of a human thumb or another finger, is interrupted.

In a further preferred embodiment of the knife according to the invention the actuating device has an actuating housing and/or a manual actuating slider. Preferably the actuating housing or the actuating slider has a plurality of grooves or channels which are arranged substantially transversely to the direction of movement and which assist with the transmission of force between the actuating device and a human finger, for example the thumb.

Further features and advantages of the invention will be apparent from the accompanying claims and the specific description hereinafter in which embodiments by way of example of the knife according to the invention are described in detail with reference to drawings in which:

DETAILED DESCRIPTION

Figure 1:
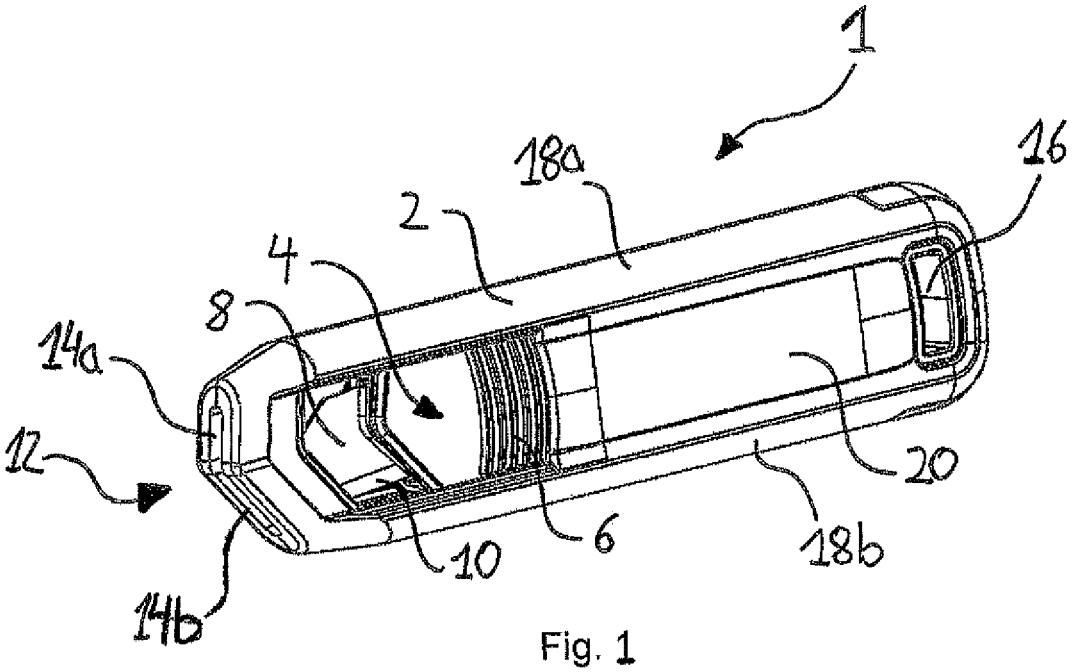
FIG. 1 shows a perspective view of a knife according to the invention, wherein the rotatable blade unit is in a retracted position.

Looking at the view in FIG. 1 the knife 1 has a housing 2 in which an actuating device 4 is arranged. The actuating device 4 includes a moveable actuating housing 6 which is guided manually slidably within the housing 2 of the knife 1. In the illustrated state of the knife 1 the actuating device 4 is in the passive position. In the passive position of the actuating device 4 an intermediate space is provided between the moveable actuating housing 6 and an inside edge of the housing 2.

A blade 8 which is arranged completely within the housing 2 extends across that free space so that the blade 8 is visible from the outside. The blade 8 has a cutting edge 10. The blade 8 can be moved from the illustrated retracted position into an extended position by means of the actuating device 4.

So that the blade 8 can leave the housing 2 of the knife 1 in the movement from the retracted position into the extended position the housing 2 has an opening slot 12 at one end. The width of the opening slot 12 is larger than the thickness of the blade 8. The opening slot 12 includes a first portion 14 *a* and a second portion 14 *b*. The second portion 14 *b* is of an outwardly inclined configuration in the direction of the center of the housing so that, when the blade 8 is moved into the extended position by means of the actuating device 4, a larger portion of the cutting edge 10 of the blade 8 protrudes from the housing 2 of the knife 1 than would be the case if the second portion 14 *b* were not of an inclined configuration.

At the side opposite the opening slot 12 the housing 2 also has an aperture 16. The aperture 16 extends through the housing 2 and is of a substantially rectangular cross-section with rounded corners. The aperture 16 can be used for example for receiving a loop so that the knife 1 can be fixed to the clothing of the knife operator for example for transport purposes. The aperture 16 can also be used to hang up the knife 1 on a mounting device. In that way the knife 1 can be stored for example hanging on a tool wall so that it is readily quickly accessible when required.

The housing 2 also has two mutually opposite rounded portions 18 *a*, 18 *b*. The rounded portions 18 *a*, 18 *b* of the housing 2 provide a positive subjective tactile perception on the part of the user of the knife 1 as the surface of the hand does not come into contact with pronounced edges. The rounded portions 18 *a*, 18 *b* of the housing 2 also make it possible for the user of the knife to apply high pressure forces to the housing 2 without a subjective feeling of pain. The rounded configurations of the rounded portions 18 *a*, 18 *b* respectively extend over an angular region of about 180 degrees.

A respective substantially flat surface 20 is arranged between the rounded portions 18 *a*, 18 *b* on both side surfaces of the knife 1. The flat surface 20 can be used for example for reproducing items of information like a knife identification or a manufacturer name.

Figure 2:
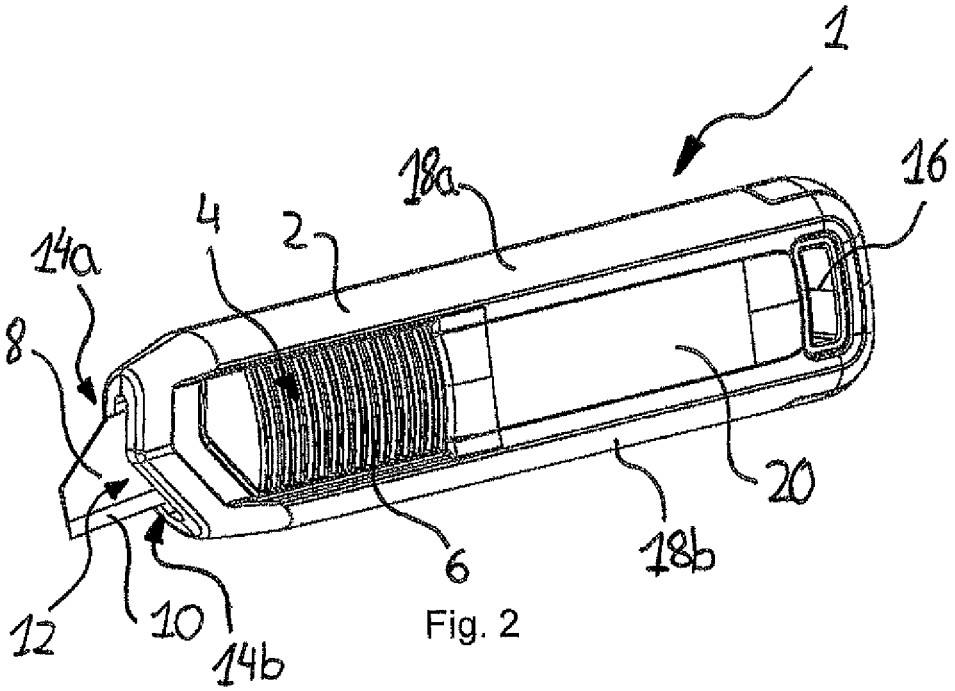
FIG. 2 shows a perspective view of a knife according to the invention, wherein the rotatable blade unit is in an extended position.

FIG. 2 shows a knife 1 according to the invention in which the blade 8 is in an extended position and the actuating device 4 is in a cutting position. In the extended position of the blade 8 it extends through the first and second portions 14 *a*, 14 *b* of the opening slot 12.

Figure 3:
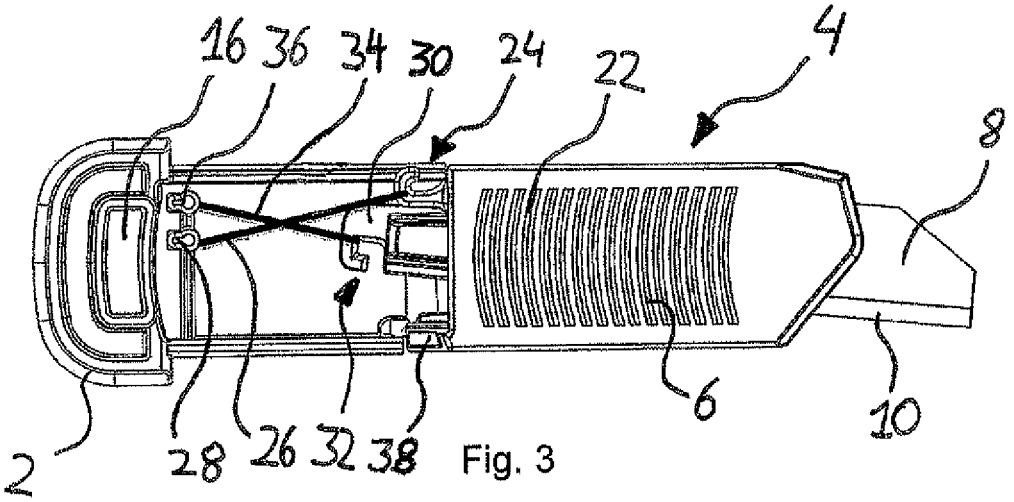
FIG. 3 shows a side view of parts of a knife according to the invention, wherein the blade unit is in an engagement position.

FIG. 3 shows a side view of parts of a knife 1 according to the invention. The moveable actuating housing 6 of the actuating device 4 has a multiplicity of grooves 22. The grooves 22 facilitate the transmission of force between the moveable actuating housing 6 of the actuating device 4 and a human finger, for example a thumb. The grooves 22 which are substantially slightly curved and which are arranged at a right angle relative to a longitudinal axis of the knife 1 improve the frictional and positively locking connection between the surface of the finger or thumb and an outside of the moveable actuating housing 6.

A fixing device 24 in the form of a hook is arranged on the moveable actuating housing 6. A retraction element 26 is fixed to the fixing device 24. The retraction element 26 is in the form of an elastically deformable coil spring. In addition the retraction element 26 is connected to the housing 2 by way of a fixing device 28. In the illustrated cutting position of the actuating device 4 the retraction element 26 applies a retraction force to the actuating device 4 in the direction of the passive position.

A rotatable blade unit 30 which also includes the blade 8 also has a fixing device 32 in the form of a hook. Arranged on the fixing device 32 is a retraction element 34 which is also in the form of an elastically deformable coil spring. The retraction element 34 is connected to the housing 2 at a further fixing device 36. The rotatable blade unit 30 is also mounted rotatably on a moveable slide member 38. The mounting point is however concealed by the moveable actuating housing 6 of the actuating device 4.

In the illustrated state the rotatable blade unit 30 is rotatable from an engagement position in which the blade unit 30 is in engagement with the actuating device 4 into a release position in which the blade unit 30 is not in engagement with the actuating device 4.

Figure 4:
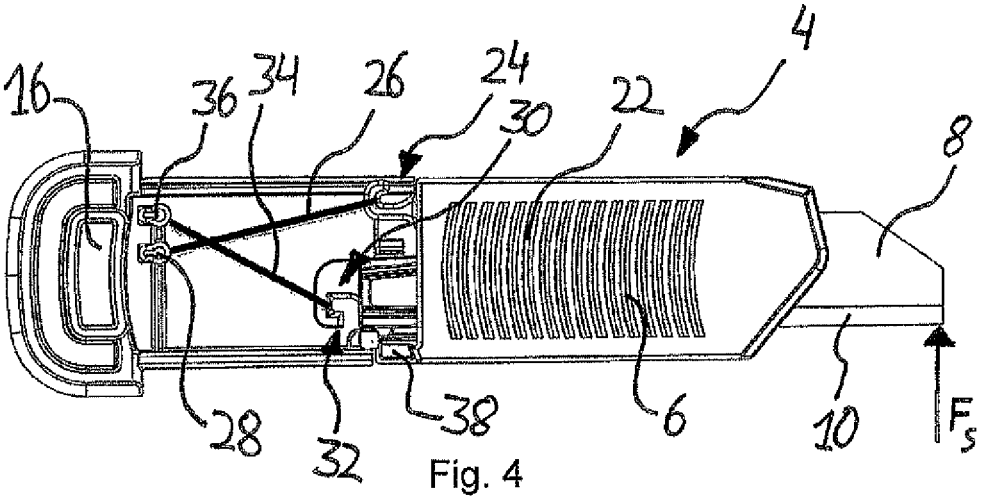
FIG. 4 shows a side view of parts of a knife according to the invention, wherein the blade unit is in a release position.

In FIG. 4 the moveable blade unit 30 is in the release position so that the blade unit 30 is not in engagement with the actuating device 4. The rotary movement of the blade unit 30 from the engagement position (FIG. 3) into the release position is implemented by the action of a cutting force Fs. The cutting force Fs is substantially produced by pressing the blade 8 or the cutting edge 10 of the blade 8 against the material to be cut. The magnitude of the cutting force which acts on the blade 8 and which causes the rotary movement of the blade unit 30 from the engagement position into the release position is dependent on the force that the user of the knife applies to the housing. The rotatable mounting of the blade unit 30 on the moveable slide member 38 is such that cutting forces which are sufficient to cut thin webs of paper already cause a rotary movement of the blade unit from the engagement position into the release position.

Figure 5:
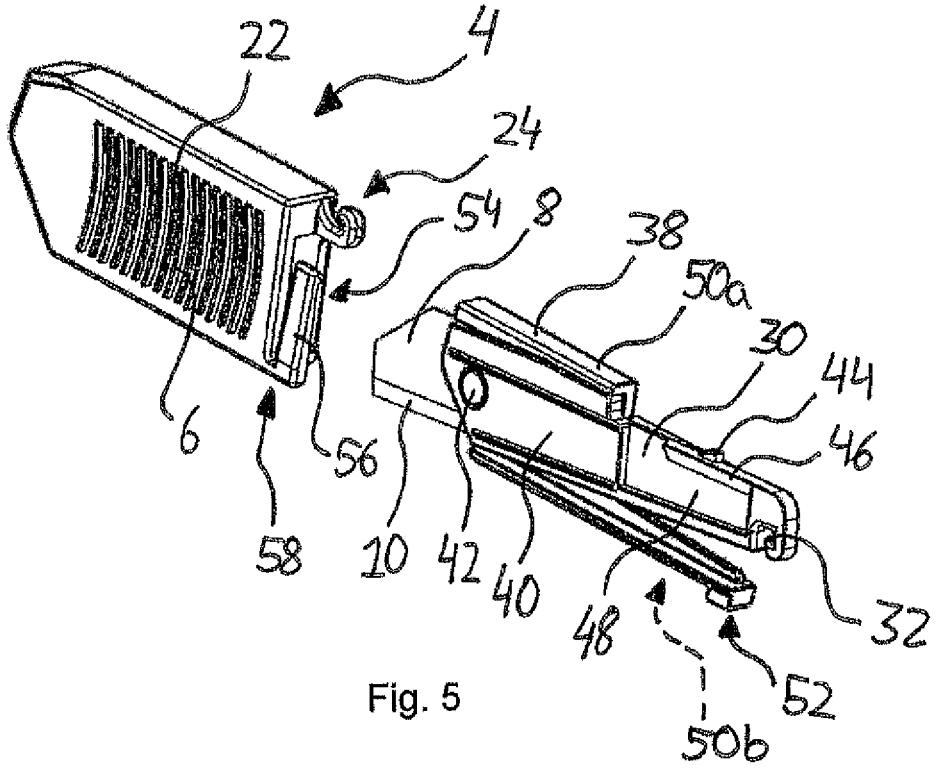
FIG. 5 shows an exploded view of parts of a knife according to the invention.

FIG. 5 shows an exploded view of parts of a knife according to the invention. The rotatable blade unit 30 includes the blade 8 and the blade carrier 40. The blade 8 is connected to the blade carrier 40 by means of the blade fixing means 42 in such a way that a rotary movement between blade and blade carrier is substantially prevented. The blade carrier 42 is made from plastic and has an entrainment member 44 in the form of a projection. The entrainment member 44 is disposed in the engagement position of the moveable blade unit 30 in engagement with the actuating device 4. When a rotary movement of the moveable blade unit 30 from the engagement position into the release position occurs the engagement of the entrainment member is released.

The blade carrier 40 further has a latching edge 46 which forms a lateral projection on the blade carrier. The projection adjoins a recess 48 in the blade carrier 40. The moveable slide member 38 on which the rotatable blade unit 30 is mounted has two mutually opposite surfaces 50 *a*, 50 *b* extending substantially parallel. The surfaces 50 *a*, 50 *b* cooperate with inside surfaces of the actuating housing 6 of the actuating device 4 in such a way as to permit longitudinal guidance for the moveable slide member 38 within the actuating housing 6. The moveable slide member 38 further has an abutment 52 which limits the longitudinal movement of the slide member 38 relative to the actuating device 4 in one direction. The limitation on the longitudinal movement of the slide member 38 is afforded by way of positively locking cooperation of the abutment 52 on the slide member 38 with an outside edge or outside surface of the actuating housing 6.

The actuating device 4 has a hook portion 54 which, with the latching edge 46 of the moveable blade unit 30, constitutes a holding mechanism in the form of a latching mechanism. The holding mechanism is adapted to prevent a rotary movement of the rotatable blade unit 30 in the direction of the engagement position after taking up the release position in a movement of the blade unit 30 from the extended position in the direction of the retracted position. In that respect the holding mechanism in the form of a latching mechanism is adapted to release the rotary movement of the blade unit 30 in the direction of the engagement position again only when the retracted position of the blade unit 30 is reached. Adjoining the hook portion 54 is a leg 56 connected to the remaining parts of the actuating device 4 by way of a material bridge 58. Upon a rotary movement of the blade unit 30 in the extended position from the engagement position into the release position the leg 56 and the hook portion 54 are elastically deflected. Elastic deflectability is achieved in particular by the capability of the material bridge 58 for twisting movement.

Figure 6:
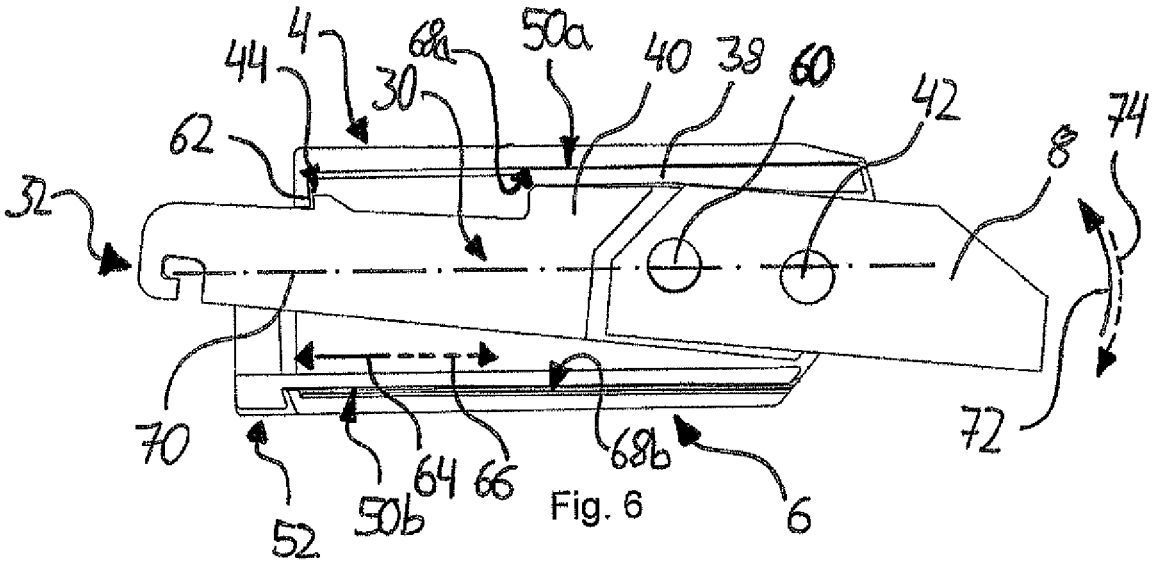
FIG. 6 shows a side view of parts of a knife according to the invention.

FIG. 6 shows a side view of parts of a knife according to the invention. The rotatable blade unit 30 which includes the blade carrier 40 and the blade 8 is connected to the moveable slide member 38 rotatably by way of the pivot mounting 60. The entrainment member 44 is disposed in the illustrated engagement position in engagement with the moveable actuating housing 6 of the actuating device 4. The engagement is achieved by a positively locking cooperation of the abutment surface 62 of the actuating housing 6 and the entrainment member 44 of the rotatable blade unit 30.

Figure 7:
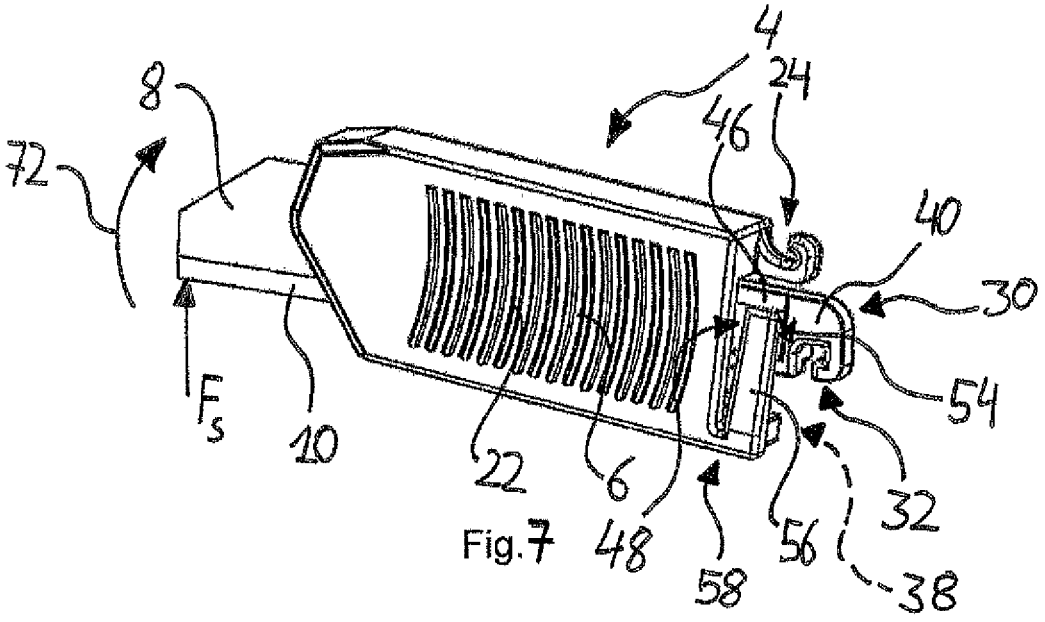
FIG. 7 shows a perspective view of parts of a knife according to the invention.

The moveable slide member 38 is moveable within the actuating device 4 in the directions 64, 66 of longitudinal movement. In the illustrated state the blade unit and the slide member are in the extended position so that they are prevented by the abutment 52 from being moved further in the direction 66. The retraction element 34 (not shown in FIG. 6) permits a longitudinal movement of the slide member 38 with blade unit 30 along the longitudinal axis 70 in the direction of the retracted position 64 when the blade unit 30 was turned from the engagement position into the release position. The rotary movement of the blade unit 30 into the release position takes place in the direction of rotation 72. The direction of rotation 74 corresponds to the movement of the blade unit 30 from the release position into the engagement position. The actuating device 4 further has guide surfaces 68 *a*, 68 *b* for the slide member, that cooperate with the surfaces 50 *a*, 50 *b* of the slide member. FIG. 7 shows the actuating housing 6 of the actuating device 4, the rotatable blade unit 30 and the moveable slide member 38. In relation to the actuating device 4 the blade unit 30 is in an extended state. In addition the blade unit is in the engagement position so that the blade unit 30 is in engagement with the actuating device 4. The hook portion 54 of the actuating device 4 is arranged beneath the latching edge 46 within the recess 48. The action of the cutting force Fs on the cutting edge 10 of the blade 8 produces a rotary movement 72 of the blade unit 30 into the release position.

Figure 8:
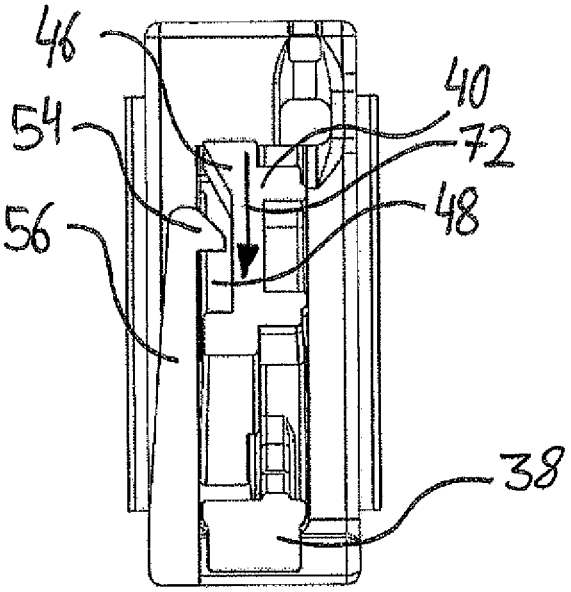
FIG. 8 shows a side view of the parts of the knife according to invention shown in FIG. 7.

FIG. 8 shows that, upon a rotary movement of the blade unit 30 in the direction of the release position (direction of rotation 72) the rear part of the blade unit 30, that is arranged in the housing (not shown), is deflected in the direction of the housing bottom. During the rotary movement of the blade unit 30 the hook portion 54 comes into a condition of engaging over the latching edge 46. During the rotary movement of the blade unit 30 in the direction of the release position the leg 56 and the hook portion 54 are elastically deflected. After engaging over the latching edge 46 the elastic deflection of the leg 56 and the hook portion 54 is ceased again. By virtue of the hook portion being in a condition of engaging over the latching edge rotary movement of the blade unit from the release position back into the engagement position is prevented.

Figure 9:
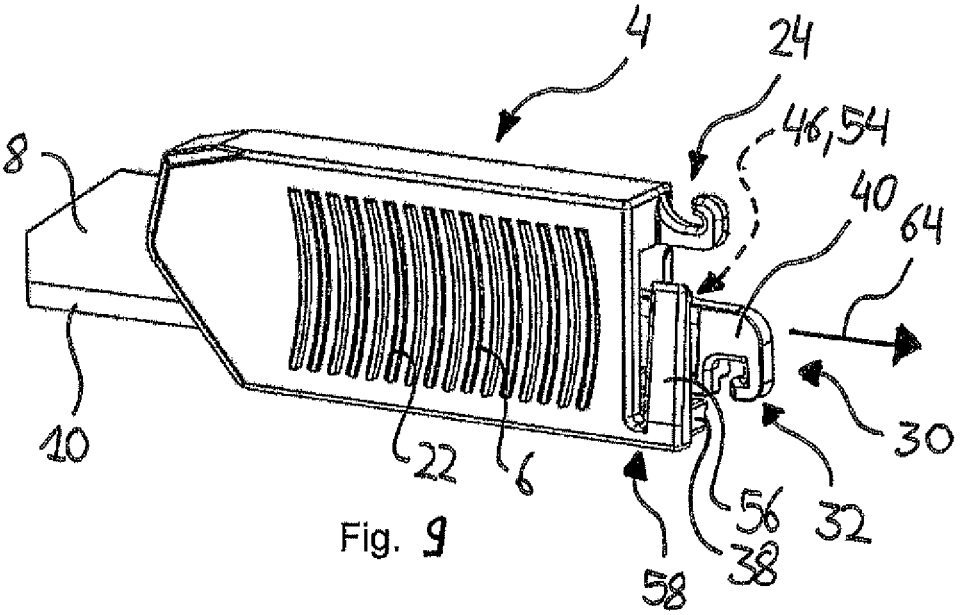
FIG. 9 shows a perspective view of parts of a knife according to the invention.

FIG. 9 shows the rotatable blade unit 30 in the release position in which the blade unit 30 is not in engagement with the actuating device 4. If when a cutting operation is interrupted the action of the cutting force on the blade 8 is terminated the blade unit 30 can be moved together with the moveable slide member 38 into the retracted position (direction of movement 64). The movement of the blade unit 30 and the slide member 38 is caused by a retraction force that a retraction element applies to the blade unit 30.

Figure 10:
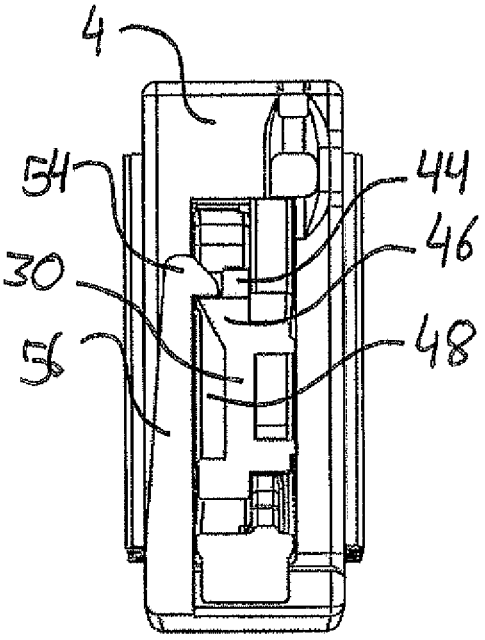
FIG. 10 shows a side view of the parts of the knife according to the invention shown in FIG. 9.

FIG. 10 shows that the entrainment member 44 no longer has a portion of the actuating device 4 engaging behind it so that a movement of the blade unit 30 in the direction of the retracted position is no longer prevented. By virtue of the holding mechanism which is implemented by a cooperation of the hook portion 54 and the latching edge 46 the rotary movement of the blade unit 30 in the direction of the engagement position is enabled again only when the retracted position of the blade unit 30 is reached.

Figure 11:
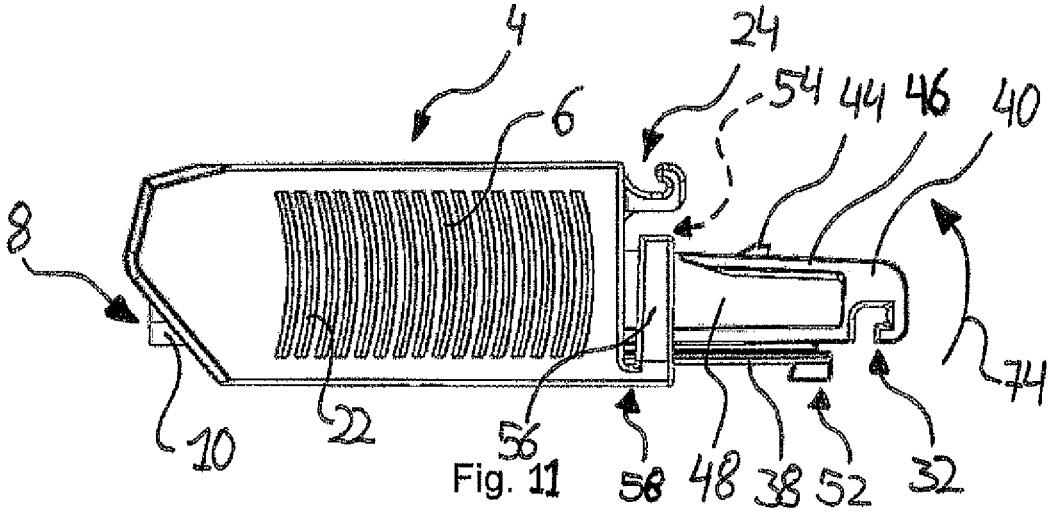
FIG. 11 shows a side view of parts of a knife according to the invention.
Figure 12:
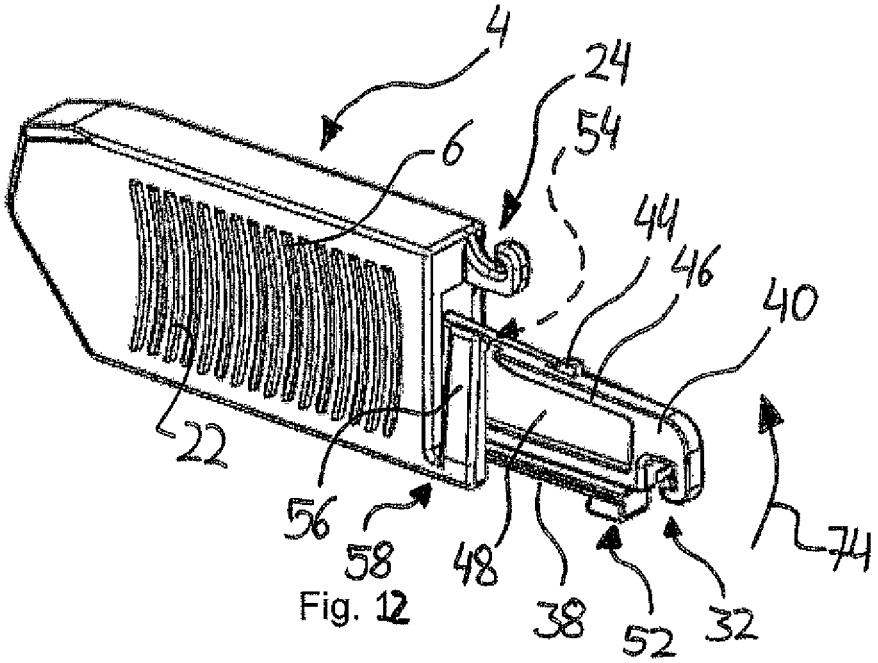
FIG. 12 shows a perspective view of the parts of the knife according to the invention as shown in FIG. 11.

FIGS. 11 and 12 show the state in which the blade unit 30 has reached the retracted position and thus the rotary movement of the blade unit 30 from the release position into the engagement position is enabled again. The rotary movement of the blade unit 30 is consequently no longer prevented by a cooperation of hook portion 54 and latching edge 46.

Figure 13:
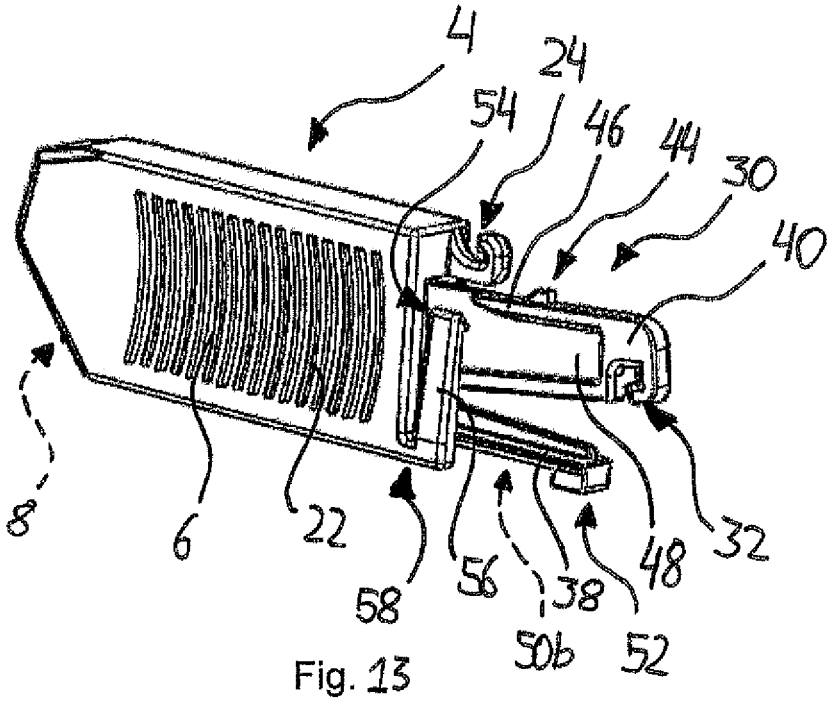
FIG. 13 shows a perspective view of parts of a knife according to the invention.

As shown in FIG. 13 the blade unit 30 can now be brought into engagement with the actuating device 4 again by retraction of the actuating device 4, for example by a further retraction element. That involves a relative movement between the blade unit 30 and the actuating device 4 so that a portion of the actuating device 4 again engages behind the entrainment member 44 of the blade unit 30. The relative movement between the blade unit 30 and the actuating device 4 is caused by the fact that, upon retraction of the actuating device 4, retraction of the blade unit is prevented by the housing (not shown) of the knife. That therefore restores the initial state of the knife so that, by actuation of the actuating device 4, that is to say by sliding displacement of the actuating housing 6, a fresh cutting operation can be begun and the automatic blade retraction is ready to operate.

The invention claimed is:

1. A knife with automatic blade retraction, the knife comprising:

a housing;

a moveable actuating device;

a moveable slide member;

a rotatable blade unit rotatably attached to the moveable slide member, the rotatable blade unit including a blade and a blade carrier, the rotatable blade unit attached to the moveable actuating device, the blade being connected to the blade carrier such that rotary movement between the blade and the blade carrier is prevented, the blade carrier including an entrainment member configured to be brought into engagement with an abutment surface of the moveable actuating device, the rotatable blade unit moveable by the moveable actuating device between a first position in which the blade is retracted in the housing and a second position in which the blade is extended from the housing, and the rotatable blade unit rotatable by the action of cutting force in the second position from an engagement position in which the entrainment member of the blade carrier is in engagement with the abutment surface of the moveable actuating device into a release position in which the entrainment member of the blade carrier is not in engagement with the abutment surface of the moveable actuating device;

a first retraction element configured to continuously apply a retraction force to the rotatable blade unit in the direction of the retracted position; and a holding mechanism including the housing or the moveable actuating device, the holding mechanism further including the rotatable blade unit, and the holding mechanism configured to prevent rotary movement of the rotatable blade unit in a direction of the engagement position, after the rotatable blade unit is in the release position, in a movement of the rotatable blade unit from the extended position in a direction of the retracted position, wherein the holding mechanism is configured to permit the rotary movement of the rotatable blade unit in the direction of the engagement position when the retracted position of the rotatable blade unit is reached, the holding mechanism comprises a latching mechanism including a first latching element and a second latching element configured to mutually cooperate with the first latching element, the housing or the moveable actuating device includes the first latching element, the rotatable blade unit includes the second latching element, the first latching element includes a hook portion, the second latching element includes a latching edge, and upon rotary movement of the rotatable blade unit in the extended position from the engagement position into the release position, the hook portion engages over the latching edge such that rotary movement of the rotatable blade unit from the release position back into the engagement position is prevented.

2. The knife of claim 1, wherein the first latching element is elastically deflected during the rotary movement of the rotatable blade unit from the engagement position into the release position when the rotatable blade unit is in the extended position.

3. The knife of claim 1, wherein the first latching element includes a leg that is in contact with the rotatable blade unit in the engagement position of the rotatable blade unit, the release position of the rotatable blade unit, or a combination thereof.

4. The knife of claim 1, wherein the moveable actuating structure is configured to be moveable between a passive position and a cutting position, and a second retraction element is configured to apply a retraction force to the moveable actuating structure in the direction of the passive position.

5. The knife of claim 1, wherein the blade is attached to the blade carrier by an adhesive connection, a stamped connection, a screw connection, a damping connection, or a combination thereof.

6. The knife of claim 1, wherein the blade includes a plurality of apertures and the blade carrier includes a plurality of projections that engage the plurality of apertures to connect the blade carrier and the blade.

7. The knife of claim 1, wherein the blade carrier remains unengaged with the moveable actuating structure when in the release position.

* * * * *